US005435432A

United States Patent [19]

Tacchi et al.

[11] Patent Number: 5,435,432

[45] Date of Patent: Jul. 25, 1995

[54] DEVICE FOR FEEDING STACKS OF CUTOUTS TO A USER MACHINE

[75] Inventors: Alver Tacchi; Alessandro Minarelli, both of Bologna, Italy

[73] Assignee: G.D. S.p.A., Bologna, Italy

[21] Appl. No.: 253,020

[22] Filed: Jun. 2, 1994

[30] Foreign Application Priority Data

Jun. 16, 1993 [IT] Italy ..... B093A0271

[51] Int. Cl.[6] ..... B65G 47/24

[52] U.S. Cl. ..... 198/409; 198/468.6; 414/685; 414/795.8

[58] Field of Search ..... 198/409, 468.6; 414/609, 728, 742, 743, 680, 685, 793.4, 795.8

[56] References Cited

U.S. PATENT DOCUMENTS

T999,001 10/1980 Bevan ..... 414/793.4
2,092,540 9/1937 Talbot ..... 198/409
4,618,054 10/1986 Muller ..... 198/468.6
5,304,030 4/1994 Neri ..... 198/409

*Primary Examiner*—Joseph E. Valenza
*Attorney, Agent, or Firm*—Guido Modiano; Albert Josif

[57] ABSTRACT

The device for feeding stacks of cutouts to a user machine, wherein a fork provided with a supporting plate suitable to support at least one stack of cutouts is connected to a slider that can slide along a straight guide under the action of a first motor; the guide can rotate about an axis which is transverse to the guide under the action of a second motor which cooperates with the first motor to move the fork between a loading station, where the supporting plate arranges itself parallel to a plane for the conveyance of the stacks, and through an unloading station formed by a magazine of the user machine, wherein a stop element allows the disengagement of the supporting plate from the conveyed stack.

14 Claims, 3 Drawing Sheets

DEVICE FOR FEEDING STACKS OF CUTOUTS TO A USER MACHINE

BACKGROUND OF THE INVENTION

The present invention relates to a device for feeding stacks of cutouts to a user machine.

In particular, the present invention relates to a device for transferring, in a fully automatic manner, stacks of cutouts to an input magazine of a user machine, constituted for example by a packaging machine.

German patent application No. 33 07 675 discloses a transfer device of the above described type comprising a loop-shaped conveyor for feeding in succession stacks of cutouts to a loading station of an L-shaped fork slideable along a fixed guide which is aligned with the direction along which the stacks advance on the conveyor and is inclined downwardly and towards an input magazine of a packaging machine.

In the above mentioned German patent the conveyor has multiple oscillating supports or pockets, each one suitable to support a stack, and is formed so that it can oscillate, at the loading station, about an axis which lies transversely to the advancement direction of the stacks along the conveyor to unload the associated stack onto the L-shaped fork.

This known device has several technical and functional drawbacks. First of all, in the above described known device it is in fact necessary to provide a conveyor which not only extends in a loop on a horizontal plane, thus occupying a relatively large space, but also has multiple oscillating supports which are intrinsically expensive and scarcely reliable.

Furthermore, more significantly, the oscillation of each support at said loading station is matched by an uncontrolled rotation of the stack as it passes from said oscillating support to the L-shaped fork, with the consequent danger of the breakup of said stack. This is due to the fact that the stack, in passing from the substantially horizontal direction of advancement along the conveyor to the inclined direction of advancement of the L-shaped fork, performs a rotation during which it moves with no control at all with respect to the L-shaped fork.

SUMMARY OF THE INVENTION

The aim of the present invention is to provide a device of the above described type which is devoid of the above mentioned drawbacks.

In particular, an object of the present invention is to provide a device of the type described above in which each stack, during said rotation, does not perform any relative movement with respect to the L-shaped fork.

According to the present invention, a device is provided for feeding stacks of cutouts to a user machine, said device comprising a first and a second conveyors for the advancement of a succession of stacks of cutouts in a first and in a second directions respectively, a loading station and an unloading station which are mutually offset; said loading station being interposed between the first and the second conveyors, said unloading station being an input station of the user machine; said second conveyor comprising a guide that extends in the second direction and fork-like means adapted for supporting at least one stack and which can move along the guide; said device being characterized in that it furthermore comprises actuation means coupled to the guide to rotate said guide about a transverse axis between a first position, in which said first and second directions are mutually aligned, and a second position, in which the second direction lies along an ideal line connecting the loading station and the unloading station and forming an angle with respect to the first direction.

BRIEF DESCRIPTION OF THE DRAWINGS

The invention is now described with reference to the accompanying drawings, which illustrate a non-limitative example thereof, wherein.

DESCRIPTION OF THE PREFERRED EMBODIMENTS

Figures 1, 2:
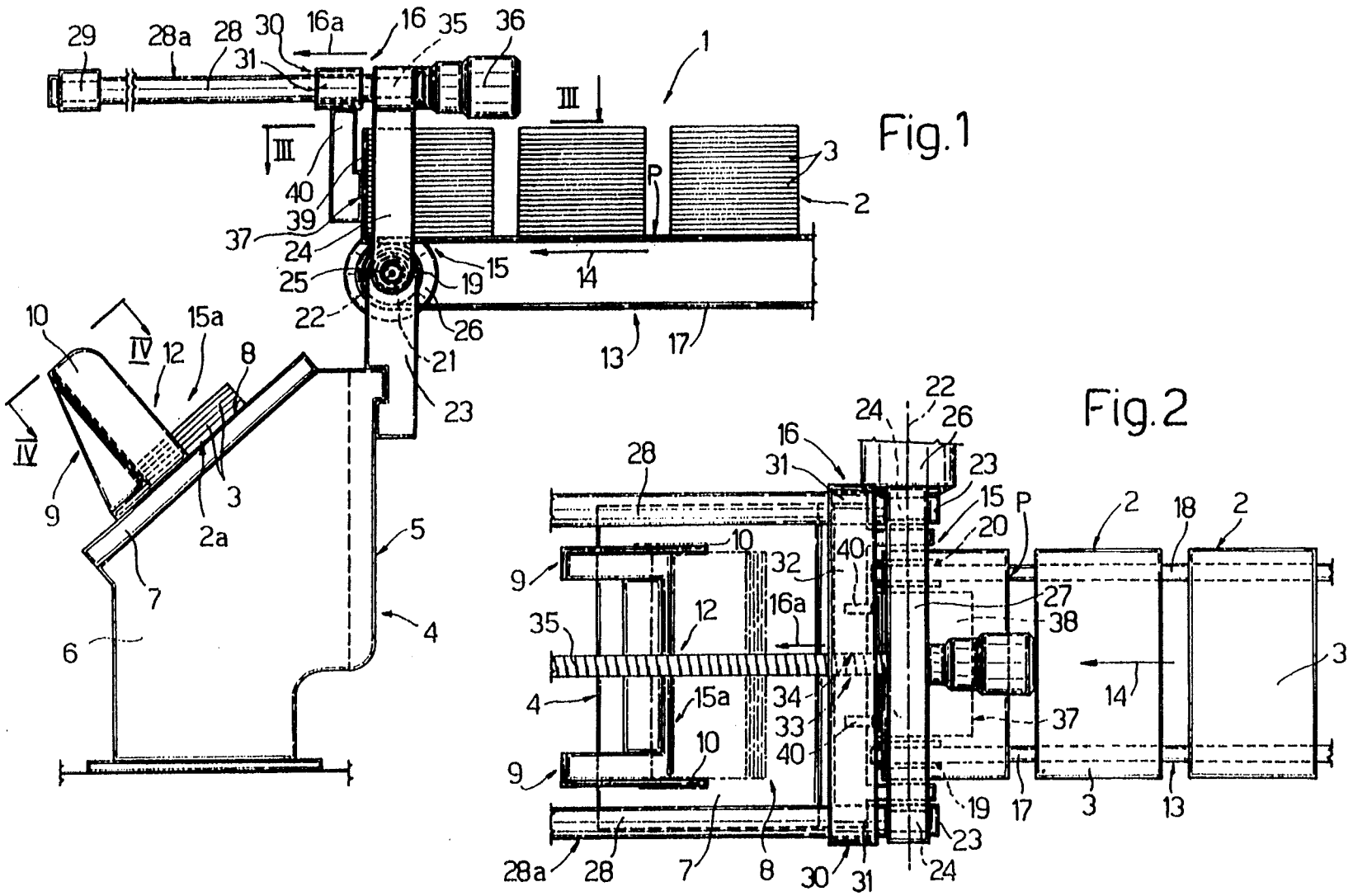
FIG. 1 is a side elevation view of a preferred embodiment of the device according to the present invention in a first operating position.
FIG. 2 is a partial plan view of the device of FIG. 1.

In FIGS. 1 and 2, the reference numeral 1 designates a device for feeding in succession stacks 2 of substantially flat cutouts 3 to a packaging machine 4 (which is partially shown).

The machine 4 comprises a case 5 which in turn comprises two vertical plates 6 and an inclined plate 7 for connecting the top ends of said plates 6. Two L-shaped wings 9 are rigidly coupled to an outer surface 8 of the plate 7 (FIGS. 1 to 6), extend at right angles to said plate 7, and are arranged in mutually spaced positions along a direction orthogonal to the plates 6. The wings 9 are angular wings comprising respective plates 10 that face one another and are parallel to the plates 6 and respective plates 11 which are mutually co-planar and extend towards each other starting from the associated plate 10 and at right angles thereto.

The wings 9 and the plate 7 form a magazine 12 which is part of the device 1 and is suitable to accommodate a plurality of stacked cutouts 3 to be fed to an input (not shown) of the machine 4 normally formed through the plate 7, which acts as a base plate for the magazine 12.

Again with reference to FIGS. 1 and 2, the device 1 furthermore comprises an input conveyor 13 arranged above, and adjacent to, an upper end of the plate 7 to cause the stacks 2 to advance to a loading station 15 in succession and in a direction 14 substantially horizontal and parallel to the plates 6, and comprises a transfer conveyor 16 which causes the stacks 2 to advance in succession in a direction **16*a* to transfer said stacks 2 from the loading station 15 to an unloading station 15*a* which is formed by the magazine 12 and is offset in a downward direction with respect to said station 15**.

Figure 3:
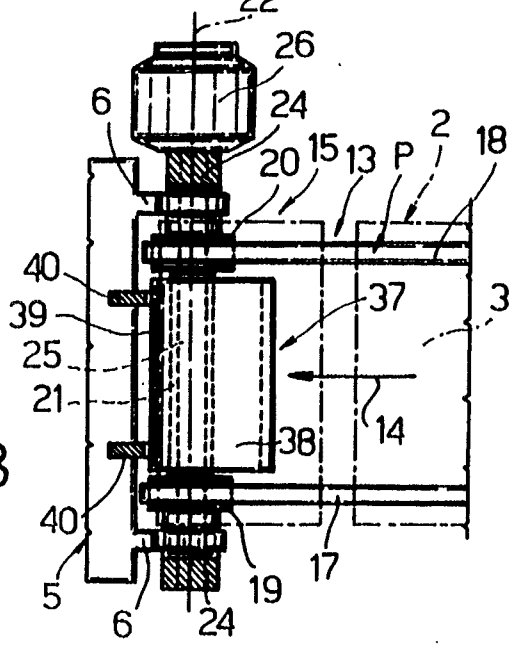
FIG. 3 is a sectional views taken along the plane III—III of FIG. 1.

The conveyor 13 comprises two mutually adjacent belts 17 and 18 which are wound in a loop around respective rollers 19 and 20 (only two of which are shown in FIGS. 2 and 3) and form a transport plane P parallel to the direction 14 and forming a non-zero angle A (FIG. 5) with the surface 8. The rollers 19 and 20, adjacent to the case 5, are keyed on a common hollow motorized supporting shaft 21 which is arranged at the station 15 and lies along an axis 22. The shaft 21 is at right angles to the direction 14, is parallel to the surface 8 and to the plane P, and is supported by two posts 23 extending vertically upwardly from said case 5.

The transfer conveyor 16 comprises a supporting bracket formed by two arms 24 which lie at right angles to the axis 22. Each arm 24 lies on the outside of an associated post 23 and has a respective end portion keyed on a common actuation shaft 25 which is coaxial and internal to the shaft 21 and can rotate about the axis 22 under the action of a motor 26 supported by one of the posts 23. The arms 24 have respective end portions which are opposite to those keyed on the shaft 25 and are rigidly connected to a beam 27 which is parallel to the axis 22. Respective end portions of two mutually parallel and spaced cylindrical rods 28 are rigidly connected to the opposite ends of the beam 27, said rods extending in a cantilevered manner from said beam 27 in the direction 16*a* which is at right angles to the axis 22 and to the arms 24 and having respective opposite ends mutually rigidly connected by an additional beam 29 which is parallel to the beam 27.

Figure 6:
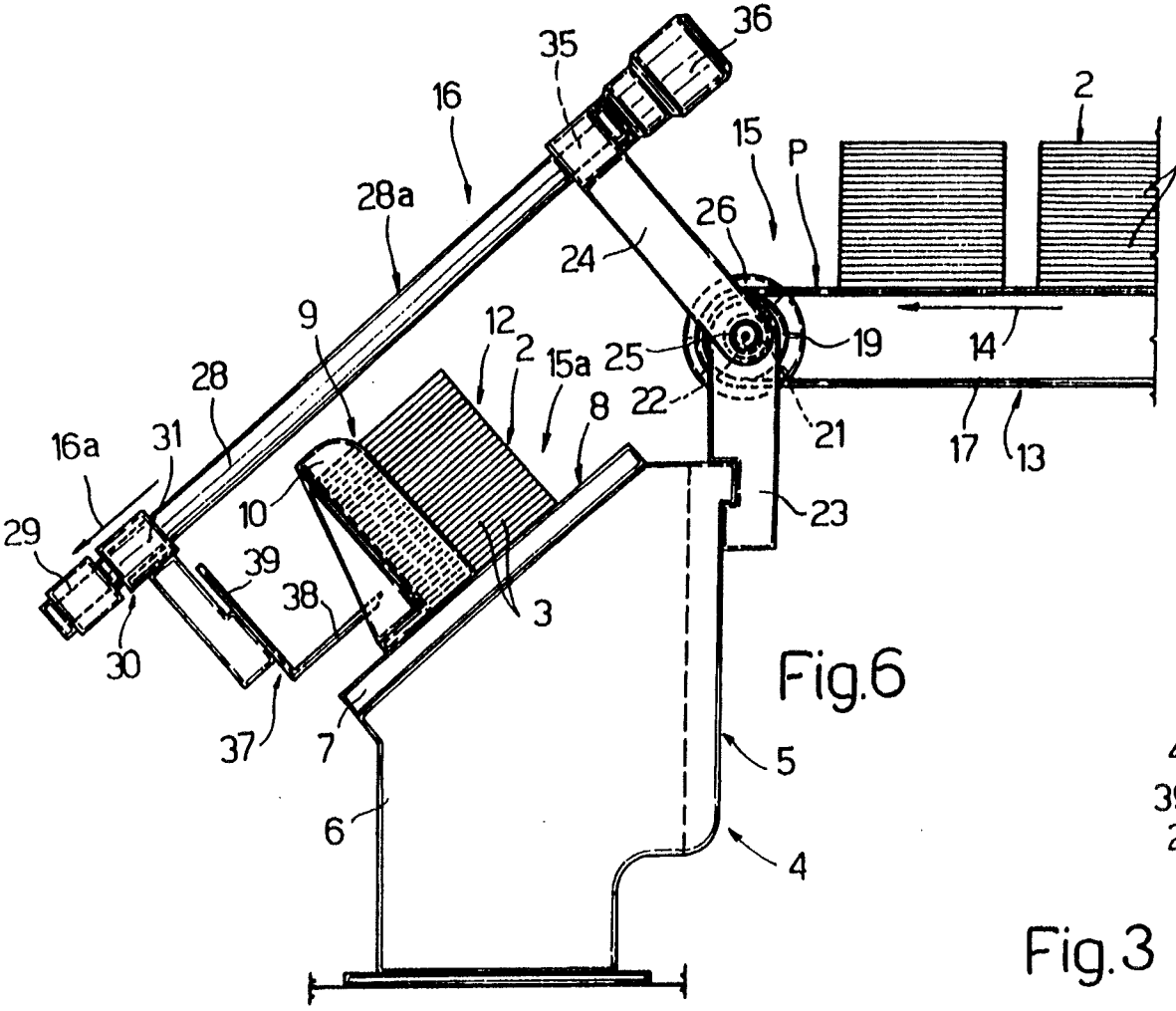
FIGS. 5 and 6 are views, similar to FIG. 1, of the device of said FIG. 1 in two additional operating positions.
Figure 5:
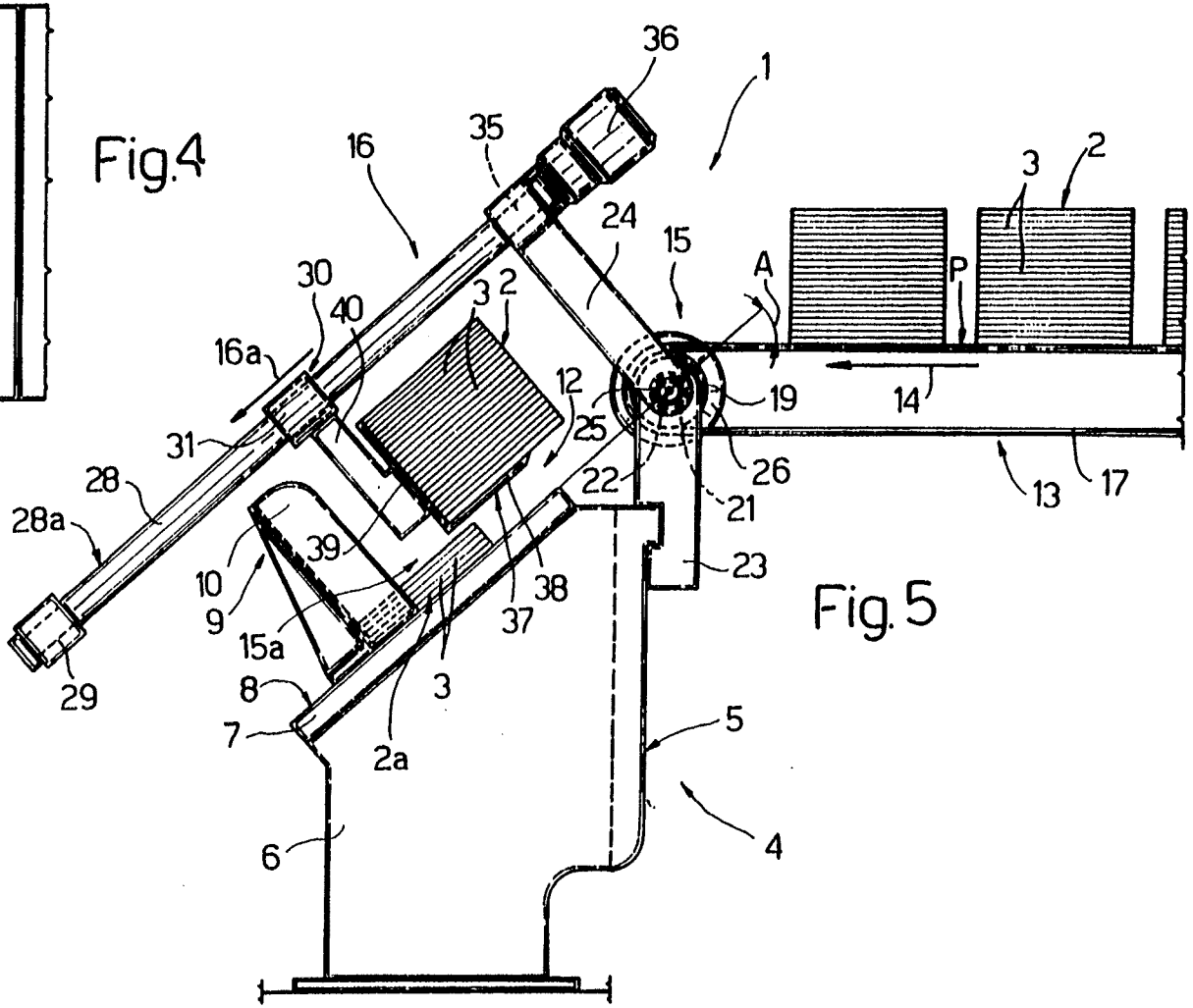
Figure 4:
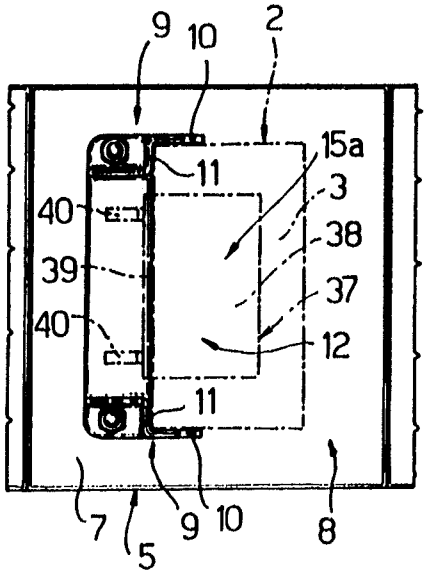
FIG. 4 is a view taken along the arrows IV—IV of FIG. 1.

The rods 28 can oscillate, under the action of the motor 26 and about the axis 22, between a first stroke limit position, shown in FIG. 1, in which the direction 16*a* is parallel to the direction 14, and a second stroke limit position, shown in FIG. 6, in which the direction 16*a* lies parallel to the surface 8 of the plate 7.

The rods 28 form a guide 28a for a slider 30 that comprises two sleeves 31; each sleeve is coupled to an associated rod 28 so that it can slide axially, and said sleeves are mutually connected by a beam 32 which is parallel to the beams 27 and 29. The slider 30 can move along the rods 28 between two extreme stroke limit positions under the action of a screw-and-nut transmission 33 (FIG. 2) comprising a nut 34 formed through the beam 32 and a screw 35 which lies between the rods 28 parallel thereto, engages the nut 34, and is actuated by its own actuation means constituted by a motor 36, supported by the beam 27.

A fork 37 for picking up the stacks 2 in the station 15 and transferring said stacks 2 to the magazine 12 is rigidly connected to the slider 30. The fork 37 is substantially L-shaped and comprises a plate 38 and a post 39 which are mutually perpendicular and rigidly connected; their width, measured parallel to the axis 22, is smaller than the distance between the belts 17 and 18, than the distance between the plates 11 of the magazine 12, and than the width of the stacks 2. The plate 38 lies parallel to the rods 28, whereas the post 39 is rigidly connected to the beam 32 by a pair of brackets 40.

The length of the brackets 40 and of the arms 24 chosen so that when the rods 28 are arranged in their first stroke limit position and the fork 37 is arranged inside the station 15, the plate 38 of said fork 37 lies between the belts 17 and 18 in a position which is coplanar to the plane P; whereas when the rods 28 are arranged in their second stroke limit position and the fork 37 is arranged proximate to the magazine 12, said fork 37 lies in the space between the rods 28 and the surface 8 so that its plate 38 lies at a distance from the surface 8 (FIGS. 5 and 6) which is smaller than the length of the wings 9.

The operation of the device 1 is now described starting from the condition in which the guide 28*a* arranged in its first position, a stack 2 is arranged the station 15, the slider 30 is arranged in an intermediate position between the beams 27 and 29, and a presence sensor, which is known and not shown and is located proximate to the magazine 12, detects that a stack 2*a* placed in said magazine 12 is about to end.

Starting from this condition, a known control unit, not shown, activates the motor 36 so as to move the slider 30 towards the beam 27 until the plate 38 of the fork 37 lies between the belts 17 and 18 and is in contact with a first cutout 3 of the stack 2 and the post 39 is in contact with a lateral surface of said stack 2. At this point said control unit not shown, deactivates the motor 36 and activates the motor 26, which rotates the arms 24 counterclockwise in FIG. 1 about the axis 22 until the guide 28*a* reaches its second stroke limit position and accordingly the plate 38 lies parallel to the surface 8. Then said control unit (not shown) deactivates the motor 26 and activates the motor 36, which by virtue of the transmission 33 gradually moves the slider 30 towards the beam 29. During this movement, the fork 37 advances through the magazine 12, passing between the wings 9, whereas the stack 2 being transferred initially occupies the space between the plates 10 and is then stopped by the plates 11, which retain it inside the magazine 12, allowing the extraction of the plate 38 and the consequent resting of the stack 2 on the remaining cutouts 3 of the stack 2*a* (FIG. 6).

Once the stack 2 has been released, the fork 37 continues in its motion, moving beyond the magazine 12, and stops in a stroke limit position in which the slider 30 arranges itself adjacent to the beam 29. When the height of the stack 2 arranged in the magazine 12 reaches a limit value, said sensor (not shown) sends a signal to the control unit (not shown) which, in response to the received signal, first of all activates the motor 26, which returns the guide 28*a* to its first operating position by means of the arms 24, and subsequently activates the motor 36, which moves the fork 37 into the station 15.

As an alternative to what has been described above, a stack 2 can be moved from the station 15 to the magazine 12 by removing said stack 2 from the conveyor 13 by moving the slider 30 along the guide 28, kept in its first stroke limit position, and by subsequently activating the motor 26 before the fork 37 has covered, along the guide 28*a*, a distance that makes it interfere with the stack 2*a* before the guide 28*a* reaches its second position. Naturally, the motors 26 and 36 can be activated simultaneously so that the rotation of the guide 28*a* about the axis 22 and the movement of the slider 30 in the direction 16*a* along the guide 28*a* occur simultaneously. In any case, whatever the activation sequence of the motors 26 and 36 is, it is important to note that the transferred stack 2 arranges itself in any case in a clearly defined position above the plate 38 and in contact with the post 39 before the fork 37 performs any transfer movement, and maintains this position, which is fixed with respect to the fork 37, throughout its transfer towards the magazine 12, thus avoiding any uncontrolled movement that might cause its breakup.

What is claimed is:

1. Device for feeding stacks of cutouts to a user machine, said device comprising a first conveyor and a second conveyor for the advancement of a succession of stacks of cutouts in a first direction and respectively in a second direction, a loading station and an unloading station which are mutually offset; said loading station being interposed between the first conveyor and the second conveyor, said unloading station being an input station of the user machine; said second conveyor comprising a guide that extends in the second direction and fork-like means adapted for supporting at least one stack, said fork-like means comprising a supporting plate and a post, said plate being rigidly connected at an end of said post to extend parallel to the guide, and said post being rigidly connected to a slider, said slider being slidingly movable along said guide, said fork-like means being thus movable along said guide; actuation means coupled to the guide to rotate said guide about an axis transversal with respect to said first direction between a first position, in which said first direction and said second direction are mutually aligned, and a second position, in which the second direction lies along an ideal line connecting the loading station and the unloading station and forming an angle with respect to the first direction; and further actuation means for actuating said slider to move along said guide, wherein said actuation means and further actuation means are activatable according to an activation sequence for moving said fork-like means to pick up a stack of cutouts from said loading station in said first position of said guide, said stack being arrangeable on said fork-like means in a supported position above said plate and in contact with said post; for rotating said guide to said second position; for moving said fork-like means along said guide for transporting to and resting said stack in said unloading station with said stack remaining during transporting in said supported position in contact with said post; for rotating said guide back to said first position; and for moving said fork-lift means again to said loading station.

2. Device according to claim 1, wherein said rotation axis is arranged at said loading station.

3. Device according to claim 1, wherein said guide comprises a supporting bracket that lies transversely to said second direction and is mounted so that it can rotate about said axis, said actuation means being coupled to said bracket.

4. Device according to claim 1, wherein the first conveyor comprises two conveyor belts which are parallel to the first direction, are transverse to said axis, are mutually adjacent, and lie at a distance from each other that is greater than a dimension of said supporting plate measured in a direction which is parallel to said axis.

5. Device according to claim 1, wherein said unloading station is formed by a magazine for said cutouts; said magazine comprising a base plate which forms said angle with respect to said first direction and two wings rigidly coupled and perpendicular to said base plate and extending from said base plate towards said guide; said wings being arranged mutually side by side in a direction parallel to said axis and at a mutual distance that is greater than a dimension of said supporting plate measured in the same direction and is smaller than a dimension of the stacks again measured in the same direction.

6. Device according to claim 5, wherein said fork-like means is suspended from said guide and lies in a space comprised between said guide and said base plate when said guide is arranged in its second position.

7. Device according to claim 1, wherein said fork-like means comprises further to the slider which is slidingly coupled to said guide, a screw-and-nut transmission, said transmission being interposed between the slider and the guide to move the slider along the guide; and said further actuation means comprises a motor being coupled to a screw of said screw- and-nut transmission.

8. Device for feeding stacks of cutouts to a user machine, said device comprising:

a supporting plate mounted on said user machine;

a first input conveyor defining a transport plane and a loading station, said loading station being located at an end of said input conveyor, and said input conveyor advancing a succession of cutout stacks along said transport plane to said loading station;

a supporting plate mounted, at said user machine, with an end thereof near said loading station, said supporting plate defining an unloading plane and an unloading station, said unloading station being an input station of said user machine, and said unloading plane forming a nonzero angle with said transport plane;

a second transfer conveyor defining a transfer direction along a guide thereof, said guide being oscillatable between a first position in which said transfer direction of said guide is parallel with said transport plane and a second position in which said transfer direction of said guide is parallel to said unloading plane;

actuation means coupled to said guide for oscillating said transfer conveyor around an axis, said axis being transversal to said transfer direction at said end of said input conveyor where said loading station is located;

fork-like means for picking up from said loading station and supporting thereon at least one stack of cutouts, said fork-like means comprising a supporting plate and a post, said plate being rigidly connected at an end of said post to extend parallel to the guide, and said post being rigidly connected to a slider, said slider being movable along the guide;

further actuation means for moving said fork-like means along said guide between said loading station and said unloading station, and wherein a stack of cutouts is picked up from said loading station in said first position of said guide by said fork-like means, said stack being arranged on said fork-like means in a supported position above said plate and in contact with said post, and said guide being oscillatable to said second position while said stack remains in said supported position and in contact with said post.

9. Device according to claim 8, wherein said guide comprises a supporting bracket that lies transversely to said transfer direction and is mounted for rotating about said axis, said actuation means being coupled to said bracket.

10. Device according to claim 8, wherein said actuation means and further actuation means are activatable according to an activation sequence for moving said fork-like means to pick up a stack of cutouts from said loading station in said first position of said guide; for rotating said guide to said second position; for moving said fork-like means along said guide for transporting to and resting said stack in said unloading station with said stack remaining during transporting in said supported position in contact with said post; for rotating said guide back to said first position; and for moving said fork-lift means again to said loading station.

11. Device according to claim 8, wherein the input conveyor comprises two mutually adjacent conveyor belts which form said transport plane, said belts being transverse to said axis and lying at a distance from each other that is greater than a dimension of said supporting plate measured in a direction which is parallel to said axis.

12. Device according to claim 8, wherein said unloading station is formed by a magazine for said cutouts; said magazine comprising a base plate which forms said angle with respect to said transport plane and two wings rigidly coupled and perpendicular to said base plate and extending from said base plate towards said guide; said wings being arranged mutually side by side in a direction parallel to said axis and at a mutual distance that is greater than a dimension of said supporting plate measured in the same direction and is smaller than a dimension of the stacks again measured in the same direction.

13. Device according to claim 12, wherein said fork-like means is suspended from said guide and lies in a space comprised between said guide and said base plate when said guide is arranged in its second position.

14. Device according to claim 8, wherein said fork-like means comprises further to the slider which is slidingly coupled to said guide, a screw-and-nut transmission, said transmission being interposed between the slider and the guide to move the slider along the guide; and said further actuation means comprising a motor being coupled to a screw of said screw-and-nut transmission.

* * * * *